United States Patent [19]

Moorhouse et al.

[11] 4,238,255

[45] Dec. 9, 1980

[54] USE OF EITHER REGULAR OR LOW-CALCIUM HETEROPOLYSACCHARIDE S-7 IN EXPLOSIVES AND COMPOSITIONS THEREBY PRODUCED

[75] Inventors: Ralph Moorhouse, Carlsbad; Jaewon L. Shim, San Diego, both of Calif.

[73] Assignee: Merck & Co., Inc., Rahway, N.J.

[21] Appl. No.: 24,923

[22] Filed: Mar. 29, 1979

[51] Int. Cl.[3] ..... C06B 31/30

[52] U.S. Cl. ..... 149/60; 149/19.7

[58] Field of Search ..... 149/19.7, 44, 60, 61

[56] References Cited

U.S. PATENT DOCUMENTS 3,660,182 5/1972 Cook et al. ..... 149/19.7 X

*Primary Examiner*—Stephen J. Lechert, Jr.

*Attorney, Agent, or Firm*—Gabriel Lopez; Hesna J. Pfeiffer; Julian S. Levitt

[57] ABSTRACT

Heteropolysaccharide S-7, either in the regular or low-calcium form, is used at levels from about 0.1 to 10%, preferably 0.1 to 3%, most preferably 0.2 to 2%, in aqueous ammonium nitrate solutions to provide explosive compositions which rapidly develop viscosity and can be easily adapted to field use.

6 Claims, No Drawings

USE OF EITHER REGULAR OR LOW-CALCIUM HETEROPOLYSACCHARIDE S-7 IN EXPLOSIVES AND COMPOSITIONS THEREBY PRODUCED

RELATIONSHIP TO THE PRIOR ART

Ammonium nitrate-based aqueous explosive compositions containing oxidizing agents and thickened with macromolecular natural gum thickeners are known in the art: U.S. Pat. Nos. 3,326,733; 3,730,790; 3,712,866; 3,741,833, (C.A. Vol. 79, 1973, 81044y); C.A., Vol. 83, 1975, 12987d; C.A. 79, 1973, 147873b, 147874c; C.A. 79, 1973, 44043b; Ger. Off. No. 2,201,027, (C.A. 77, 1972, 166839u); Ger. Off. No. 2,241,343, (C.A. 78, 1973, 149447u; U.S. Pat. No. 3,788,909, and others. Many known heteropolysaccharides are used in the literature, including xanthan gum, starch, guar gum, locust bean gum, and other natural or semi-synthetic polymers.

Heteropolysaccharide S-7 is disclosed and claimed in U.S. Pat. No. 3,915,800 to thicken various aqueous media, including oil well drilling muds, a suspending agent in aqueous inorganic suspensions, textile printing pastes, herbicide compositions, cleaners and polishes, and adhesive compositions, as well as various food uses.

A low-calcium form of heteropolysaccharide S-7, is disclosed in copending application, U.S. Ser. No. 018,955, filed Mar. 9, 1979. The compound is taught as having superior suspending properties due to an increased yield point over regular S-7, and can be used in drilling muds, liquid feed supplements, or other suspension uses.

SUMMARY OF THE INVENTION

It has now been found that either regular or low-calcium S-7 can be used in hot aqueous ammonium nitrate solutions to quickly develop high viscosities, due to rapid hydration rates. As hydration times are highly unpredictable from one heteropolysaccharide to another, this unexpected finding results in the use of regular or low-calcium S-7 in explosives. Although the S-7 gums can be used at levels of from about 0.1 to 10% (general prior art levels), the viscosity development is so rapid that preferred levels of from about 0.1 to 3%, or most preferred 0.2 to 2%, afford a serious economic advantage over many other gums.

A typical composition benefited by the use of these gums contains ammonium nitrate, oxidizing agents such as $NaNO_2$, $Na_2Cr_2O_7.2H_2O$; fuel oil; and small amounts of sensitizers or gassing agents; and water. Particularly preferred compositions are found in U.S. Pat. No. 3,788,909, incorporated by reference herein.

This invention is illustrated by the following examples.

EXAMPLE 1

Samples of regular or low-calcium S-7 gums prepared as described in the prior art were evaluated in a standard $NH_4NO_3$ solution assay. The purpose of this assay is to determine the rate of viscosity development (and solubility) of the gums in concentrated $NH_4NO_3$ solutions, which are representative of commercial explosive mixtures.

Solutions are made as follows: a aqueous solution of $NH_4NO_3$ was prepared containing 76.8% $NH_4NO_3$ (weight basis). Dry gum was added so that final levels of gum was 0.36% (weight basis). Test temperature was 65° C. Viscosity at one hour and at 3 hours is measured, using a Brookfield-HAT viscometer at 20 rpm, No. 2 spindle. In the system used, desirable viscosities are over 350 cP at one hour and in the range of 700–800 cP or higher at 3 hours. Viscosities are also measured for other times as indicated.

The following table summarizes the results obtained.

TABLE I

| | Viscosity (cP) | | | | |
|---|---|---|---|---|---|
| | 1 hr. | 3 hrs. | 5 hrs. | 17 hrs. | 18 hrs. |
| Regular Calcium S-7 (produced as in U.S. Patent 3,915,800) | | | | | |
| Sample 1 | 672 | 1148 | — | — | 1168 |
| | 504 | 960 | — | 1108 | — |
| | 548 | 1068 | — | — | 11 |
| Sample 2 | 1144 | 1424 | — | — | 1288 |
| | 1076 | 1344 | — | 1332 | — |
| | 1020 | 1420 | — | — | — |
| Low-Calcium S-7 (produced as described in K-1995, see Example 2, below | | | | | |
| Sample 3 | 244 | 676 | 1040 | — | — |
| | 384 | 836 | — | — | — |
| Sample 4 | 628 | 1740 | — | — | 1548 |
| | 352 | 1360 | — | 2044 | — |

The data show that a regular $Ca^{2+}$ sample of S-7 (e.g., Sample 2) has a rapid initial hydration and viscosity development, exceeding 1000 cP in 1 hour, subsequently increasing to 1300–1400 cP after 3 hrs; this can then be maintained over at least 17 hours at 65° C. Low-calcium S-7 does not appear to have the same rapid initial rate of hydration, at least on the sample evaluated. However, both the 3 hours and 17 hour viscosities can be considerably higher than for regular calcium S-7.

The rapid initial hydration and viscosity development is particularly apparent in regular calcium S-7. However, both regular and low-calcium S-7 have properties which would be attractive in explosive applications where there is a need for a system that can be formulated and utilized at short notice.

EXAMPLE 2

Production of Low-Calcium S-7, from K-1995, U.S. SN 018,955, filed Mar. 9, 1979

Seed Development

Flask seeds are started by inoculating YM (Difco) flasks (500-ml flask with 100-ml medium) with fresh YM plates of *Azotobacter indicus* var. *myoxogenes*. The flasks are incubated at 30° C. on a shaker (300–400 rpm) for 24–48 hrs, at which point the two flasks are used to inoculate 1-gallon fermentors. The medium in the one-gallon fermentors (3L) is prepared in deionized water and contains:

| | |
|---|---|
| 3.0% | Dextrose (autoclaved and added separately) |
| 0.5% | $K_2HPO_4$ |
| 0.09% | $NH_4NO_3$ |
| 0.01% | $MgSO_4.7H_2O$ |
| 1 ml/L | K-1 salts (filter sterilized and added separately) |
| 2 ml/L | Sag 471 (Union Carbiae) |

The fermentor is started with 1 L of air per minute and an agitation of 400 rpm. At 30 hrs, this seen is used (2L) to start a 20L fermentor.

Final Fermentor

The 20L fermentor contains 20L of media prepared with deionized water and contains the following ingredients:

| | |
|---|---|
| 3.0% | Dextrose (autoclaved and added separately) |
| 0.05% | $K_2HPO_4$ |
| 0.09% | $NH_4NO_3$ *(autoclaved and added separately)* |
| 0.05% | Promosoy 100 |
| 0.1% | $MgSO_4.7H_2O$ |
| 1 ml/L | K-1 salts (filter sterilized and added separately) |
| 10 ml | Sag 471 (Union Carbide) |

The fermentor is started with an aeration rate of 10L/min. which remains constant for the entire fermentation. The agitation is started at 300 rpm and increased to 700 rpm at 16–24 hrs. The fermentation temperature is 30° C. The pH is controlled at 6.5–7.0 using the automatic addition of 25% KOH for neutralization. The fermentation liquor is pasteurized at 80° C. for 12 min. after the fermentation is complete. The fermentation is complete by 60 hrs, at which point the glucose concentration is less than 0.2%. The fermentation liquor viscosity is 4250 cP.

The gum is recovered from the fermentation liquor by precipitation with three volumes of 99% isopropanol. The fibers are collected and dried at 50° C. for one hour in a forced-air tray drier.

I claim:

1. An aqueous explosive composition containing as thickening agent, from 0.1 to 10% (w/w) heteropolysaccharide S-7 in either regular or low-calcium form.

2. The composition of claim 1 in which 0.1 to 3% is used.

3. The composition of claim 2 in which 0.2-2% is used.

4. The method of thickening aqueous explosive compositions adding from 0.1 to 10% (w/w) heteropolysaccharide S-7, in either regular or low-calcium form, to an aqueous ammonium nitrate: oxidizing agent explosive composition.

5. The method of claim 4 in which 0.1 to 3% is used.

6. The method of claim 5 in which 0.2 to 2% is used.

* * * * *